United States Patent [19]

Bennett

[11] Patent Number: 5,052,329

[45] Date of Patent: Oct. 1, 1991

[54] COMBINED MINE PROBE AND MARKER

[75] Inventor: Stephen H. Bennett, Lorton, Va.

[73] Assignee: The United States of America as represented by the Secretary of the Army, Washington, D.C.

[21] Appl. No.: 403,424

[22] Filed: Sep. 6, 1989

[51] Int. Cl.[5] ..... G01D 21/00

[52] U.S. Cl. ..... 116/209; 362/34; 362/120

[58] Field of Search ..... 116/202, 209, 63 P; 362/34, 84, 102, 119, 120, 431

[56] References Cited

U.S. PATENT DOCUMENTS

| | | | |
|---|---|---|---|
| 1,508,206 | 9/1924 | Waters | 362/431 |
| 1,890,841 | 12/1932 | Brown | 362/119 |
| 3,802,378 | 4/1974 | Kessler | 116/63 P |
| 3,875,602 | 4/1975 | Miron | 362/34 |
| 3,905,324 | 9/1975 | English | 116/63 P |
| 3,933,118 | 1/1976 | Lyons et al. | 116/63 P |
| 3,934,539 | 1/1976 | Little et al. | 362/34 |
| 4,186,426 | 1/1980 | Gingras, Sr. et al. | 362/34 |
| 4,678,450 | 7/1987 | Scolari et al. | 362/102 |
| 4,812,952 | 3/1989 | Clemens | 362/84 |
| 4,856,792 | 8/1989 | Hardison | 362/34 |

*Primary Examiner*—Thomas B. Will

*Attorney, Agent, or Firm*—Anthony T. Lane; Werten F. W. Bellamy; Charles D. Miller

[57] ABSTRACT

A combined probe and marker for probing mines as well as marking mines once they have been discovered, and marking a path free of mines, comprises a rod rigidly connected to a handle. At the upper end of the handle, there is a recess for frictionally holding a Combat Light Device. In another version of this invention, the handle has a central bore followed by a concentric threaded bore at the lower end of the handle. The rod is affixed to one of the threaded ends of a stub which has a middle enlarged section for removably attaching and storing the rod.

5 Claims, 1 Drawing Sheet

COMBINED MINE PROBE AND MARKER

GOVERNMENT INTEREST

The invention described herein may be manufactured and used by or for the United States Government for Governmental purposes without the payment of any royalties and is being assigned to the United States Government.

BACKGROUND OF THE INVENTION

1. Field of Invention

This invention relates to a combined probe and marker, which may also specifically be associated with luminescent marker means for marking a minefield after successful probing.

2. Description of Prior Art

Markers for locating geographical points such as points on boundary lines, buried objects and the like are known to the art. Various markers are shown in the following U.S. Pat. Nos.:

3,916,821 discloses a geographic boundary marker assembly having a marker member mounted on an upright stake made of iron. The marker member has a housing on the top portion thereof for storing a magnet which is held to the upper end of the iron stake by magnetic force. 3,899,856 discloses a property boundary marker which is formed by two flat, notched planar members intersecting at a right angle forming a column. The marker may be extended in length by adding another column of notched planar members by vertically slipping the planars onto the matching planar of the first column. The planars of the two columns are held by tabs which are provided at the matching edges.

3,635,232 discloses a camping tent stake having a cleat member along a shank edge for rope engagment. A plurality of louver channels is provided on the opposite side of the shank of the stake. The purpose of the louver channels is to facilitate anchoring of the stake.

2,660,822 discloses a surveyer's grading marker which consists of a stake to be driven into the ground and a paper sheath affixed to the other end of the stake having pigmented marking to indicate the depth of earth to be filled or removed in order to grade the terrain level.

SUMMARY OF THE INVENTION

The primary object of this invention is to provide a dual-purpose device for probing for buried mines as well as to mark the location of such mines once they have been detected.

Another object is to provide a luminescent marker which may be directional or non-directional.

Still another object is to provide a combined probe and marker which can be stored compactly within its handle such that a soldier can attach it to his belt for carrying.

The combined probe and marker hereinafter referred to as either probe or marker, or as probe and marker, in accordance with the present invention preferably comprises either integral or separable probing rod and handle components, such as a cylindrical handle and a coaxial elongated rod having at least its distal pointed end being made of high-strength fiberglass-reinforced epoxy resin. This end is intended to be carefully forced into the ground to probe for mines and to subsequently impale the probe in the ground nearby a mine once it has been detected. Luminescent marker means such as luminescent tape or a type of chemical light are then preferably associated therewith to effectively identify the danger zone. The proximate end of the rod is rigidly attached to the lower end of the handle which attachment may be either of permanent or separable character.

The upper end of the probe handle has a recess into which may be fitted a Combat Light Device, which is a cylindrical case containing a chemical light. An alternative method of marking is to insert a chemical light through an opening traversing the diameter of the handle.

In one of the preferred embodiments, the handle is provided with a longitudinal central sheathing bore for storing the probe rod when it is not in use.

The objectives and advantages of the present combined probe and marker will be readily apparent from the following detailed description and the drawings.

DETAILED DESCRIPTION OF THE PREFERRED EMBODIMENTS OF THE INVENTION

Figure 1:
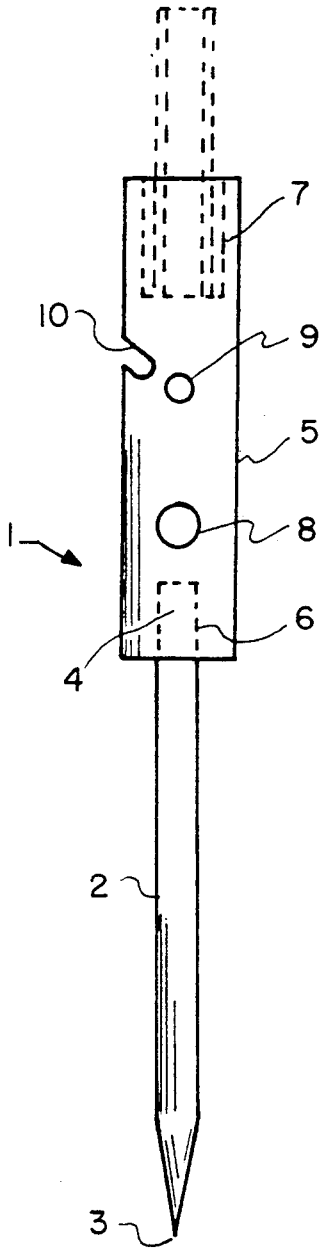
FIG. 1 is a side view of the combined probe and marker according to a first embodiment in which the rod is permanently attached to the handle.

Despite advances in the technology of mine detecting devices i.e. metal sensing or earth density sensing means, the most reliable method for locating buried mines is probing with a non-metallic probe, or using such a probe in combination with a metal detector. To use the probe, the soldier gently inserts the probe in the ground approximately at a 45 degree angle seeking locate a suspected buried mine, relying on his sense of touch. Since mines are sensitive to the presence of metals as well as electric and magnetic fields, the mine probe must be nonmetallic and all sources of electric or magnetic fields must be excluded to avoid detonation of the mine.

In the following detailed description and the drawings, like reference numerals indicate like parts.

Referring FIG. 1, the probe and marker, generally referred to as 1, comprises a probing rod 2, having a pointed distal or lower end 3. The rod 2 is made of a strong, high-impact, nonmetallic material such as fiberglass-reinforced epoxy resin. Its upper end 4 may be fixedly connected in a socket 6 of handle 5 with a high-strength glue such as the epoxy glue sold by 3M Inc. under the trademark or trade name Scotch-Weld. Alternatively, the rod and handle may be held by friction or molded as one piece. A sheath is preferably used for carrying this device, one form hereof being of self-storing character as shall be described hereinafter.

At the opposite or upper end of the handle 5, there is provided a central recess 7 for holding a Combat Light Device, shown in dotted lines and not part of the invention, which is a chemical light disposed in a separate cylindrical case which is held in the recess by friction.

An opening 8, in the vincinity of the lower end of the handle, traversing the handle 5 is provided for holding a chemical light, not shown. A second opening 9 traverses the handle 5 in the vincinity of the recess 7, in said opening to secure a string, rope or tape used to mark a path free of mines. More preferably, a notch 10 may be provided on the surface of the handle to secure the marker tape or string used to mark a path.

The probing rod is preferably made of fiberglass-reinforced expoxy resin. The handle may be made of high-impact polyacetal resin sold by E. I. DuPont de Nemours under the trade name of Delrin. Other resins such as acrylonitrile/butadiene/styrene or polycarbonate are also acceptable. The overall length of the probe and marker is about 13", the rod 2 being about 7". The diameter of the rod 2 is ½" to ⅜", and that of the handle 1¼" to 1½". The recess 7 at the top of the handle is ¾" to 1" in diameter and 1" to 2" deep. The diameter of the transverse opening 8 is ⅜" to ⅝" and that of the second transverse opening 9, ⅜". The dimensions of the recess 7 and opening 8 are designed to accomodate the standard size of the Combat Light Device and the chemical light tube. When Combat Light Devices or chemical lights having other than standard dimensions are used, the dimensions of the recess 7 and the opening 8 are adapted to the dimensions of such Combat Light Devices and chemical lights.

Figure 2:
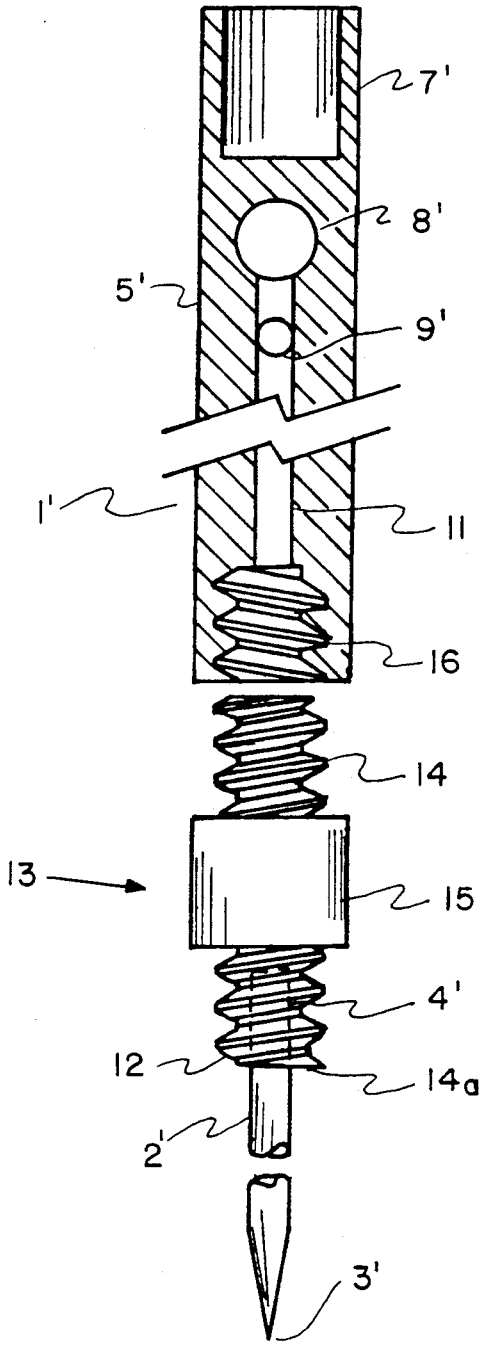
FIG. 2 is a side view of a second preferred embodiment of the invention in which the probing rod may be stored within the handle when not in use.

In the alternate prefered embodiment, illustrated by FIG. 2, the probe is generally denoted as 1', having a probing rod 2' and handle 5' which is illustrated in cross section. The handle 5' serves as a sheath. For this purpose, handle 5' is provided with a central longitudinal sheathing bore 11 having a length slightly in excess of that of the probing rod 2'. Item 7' identifies the same recess as item 7 of FIG. 1. Item 8' identifies a transverse opening for a light and item 9' identifies a transverse opening for a string or rope ect. The rod 2' has a pointed distal end 3' and a opposite proximate end 4' which is preferably rigidly connected within a bore 12 in one end 14*a* of an intermediate mounting stub 13 having two identical opposite ends 14 and 14*a* provided with male threads. However the above mentioned connections may be other than gluing. Other means of connecting may be by friction or molded as one integral piece or the like. The central hub portion 15 of stub 13 preferably has the same diameter as the handle 5'. At the lower end of the handle 5', there is provided a bore 16 coaxial with the handle, and having an internal female thread matching the male thread of the ends 14 and 14*a* of the stub 13. The threaded bore 16 communicates with the sheathing bore 11. This threaded bored 16 has an inside diameter same as the outside diameter of the stub ends. When the rod 2' is in use, stub end 14 is screwed into the bore 16. When the rod 2' is not in use, it is stored inside the handle 5', being placed in the sheathing bore 11, and the other end of 14*a* of the stub 13 is screwed into the bore 16. The central hub portion 15 of the stub 13 is provided with a knurled outer surface to facilitate removing the rod from the handle and reattaching it for use. The outer surface of the central hub is flush with the outer surface of the handle 5'.

With regard to the associated use of a commercially available Combat Light Device, a chemical light tube is disposed in a separate plastic case. The chemical light is generated by reaction of chemical reactants separately conatained in a flexible transparent tube. One such light is available from American Cyanamid Company under the tradename of Cyalume. The separate case is usually a cylindrical plastic opaque case with a cap at one end for inserting or removing the chemical light tube. An elongated gate and a shutter behind the gate are provided at the side of the plastic case. The shutter is closed or opened by turning a knob attached to the shutter in the vicinity of the cap. By adjusting the shutter, the opening formed by the gate and the shutter may be varied or the light is only showing certain direction when the shutter is partially closed. The flexible chemical light without its opaque plastic case may be inserted into the opening traversing the tube for visibility from all directions. Chemical lights are commercially available yellow, blue and green. Infrared lights are also available which are visible with infrared detection equipment. In the latter case, the light is not luminescent.

It is apparent that the aforedescribed probe and marker embodiments are multi-purpose devices. Each of them is used to probe for buried objects such as mines and to mark the mines once discovered, and to mark a safe path free of mines. The probe and marker is easy to store and quick to assemble for civilian or military uses.

In view of the foregoing descriptions, other modifications and variations of the present invention will become apparent to those skilled in the art without departing from the spirit and scope of the appended claims.

What is claimed is:

1. A combined probe and marker comprising;

a non-metallic rod having a distal pointed end and a proximate end;

a handle having an uper end, a lower end, a recess formed in the upper end of the handle for holding a cylindrically shaped chemical light means, a central longitudinal sheathing bore formed within the handle, and a concentric, internally threaded bore disposed at the lower end of the handle and in comunication with the sheathing bore; and a mounting stub for connecting the proximate end of the rod to the lower end of the handle;

wherein said mounting stub has a central affixed between first and second stub ends having external threads, the threaded stub ends being in matching relationship with the threaded bore of the handle; wherein the proximate end of the rod is mounted in a bore formed within the first stub end of the mounting stub, wherein the rod is removably attached to the handle by engaging the second stub end with the threaded bore of the handle for probing and marking and wherein the rod is stored within the central sheathing bore when not in use by reversing the mounting stub and engaging the first stub end with the threaded bore of the handle.

2. The probe and marker of claim 1 further comprising an opening transverse through the handle for holding a chemical light.

3. The probe and marker of claim 1 further comprising an opening transverse through the handle, adjacent to the recess for securing a rope.

4. The probe and marker of claim 1 wherein the probing rod is made of fiberglass-reinforced expoxy resin and the handle is made of high-impact polyacetal resin.

5. The probe and marker of claim 1 wherein the central hub is of the same diameter as the handle and its outer surface is knurled.

* * * * *